US008616528B2

(12) United States Patent
Gray, II et al.

(10) Patent No.: US 8,616,528 B2
(45) Date of Patent: Dec. 31, 2013

(54) INTEGRATED HYDRAULIC MOTOR AND WINCH

(75) Inventors: Roger Paul Gray, II, Greeneville, TN (US); Mark Schuster, Greeneville, TN (US); Richard Hynes, Greeneville, TN (US); Jason Richardson, Chuckey, TN (US); Jim McBurnett, Afton, TN (US); Brook Cutshaw, Greeneville, TN (US)

(73) Assignee: Parker Hannifin Corporation, Cleveland, OH (US)

( * ) Notice: Subject to any disclaimer, the term of this patent is extended or adjusted under 35 U.S.C. 154(b) by 927 days.

(21) Appl. No.: 12/644,290

(22) Filed: Dec. 22, 2009

(65) Prior Publication Data

US 2010/0176358 A1 Jul. 15, 2010

Related U.S. Application Data

(60) Provisional application No. 61/144,855, filed on Jan. 15, 2009.

(51) Int. Cl.
*B66D 1/08* (2006.01)

(52) U.S. Cl.
USPC ..... 254/361; 254/360

(58) Field of Classification Search
USPC ..... 254/360, 361; 418/61.3, 166, 167, 171, 418/186, 187; 60/484, 424
IPC ..... B66D 1/08; F01C 1/10
See application file for complete search history.

(56) References Cited

U.S. PATENT DOCUMENTS 3,157,350 A * 11/1964 Fraser ..... 418/167
3,272,130 A * 9/1966 Mosbacher ..... 418/9
3,682,442 A 8/1972 Baldwin
3,788,605 A 1/1974 Johnson
4,457,677 A 7/1984 Todd
4,563,136 A 1/1986 Gervais et al.
4,586,885 A * 5/1986 Middlekauff ..... 418/61.3
(Continued)

FOREIGN PATENT DOCUMENTS

EP 1012102 B1 6/1998

OTHER PUBLICATIONS

Parker Hannifin Corporation, LSHT Torqmotors and Nichols Motors 716 Series, Catalog Series HY13-1590-005/US,EU pp. 220-230, Greeneville TN, US.

*Primary Examiner* — Emmanuel M Marcelo
*Assistant Examiner* — Justin Stefanon
(74) *Attorney, Agent, or Firm* — Renner, Otto, Boisselle & Sklar, LLP

(57) ABSTRACT

Hydraulic powered assemblies 10 and 110 are disclosed. The assembly 10 includes a support unit 12, a hydraulic motor 14, and a driven member 16 that is integral with the hydraulic motor 14. The hydraulic motor 14 includes a power group 32 that includes six gerotor power units **34*a*-34*f*. Each gerotor power unit 34*a*-34*f* includes an inner rotor 40 that is fixed to a stationary through-shaft 24 and an outer rotor 42 that is mounted for hypocycloidal movement relative to the inner rotor 40. The driven member 16 includes segments 51 that support the outer rotors 40 within the segments 51. The segments 51 carry a winch cable receiving member 60 when the assembly 10 is used as a winch. The hydraulic powered assembly 110 is an alternative embodiment that includes two power groups 131 and 132. The power groups 131 and 133** may be symmetrical or asymmetrical.

23 Claims, 4 Drawing Sheets

(56) References Cited

U.S. PATENT DOCUMENTS

| | | | | |
|---|---|---|---|---|
| 4,736,929 | A | 4/1988 | McMorris | |
| 5,692,735 | A | 12/1997 | Aho et al. | |
| 5,842,684 | A | 12/1998 | Aho | |
| 6,095,500 | A | 8/2000 | McVaugh | |
| 6,544,018 | B2 | 4/2003 | Heckel et al. | |
| 7,261,277 | B2 | 8/2007 | Copeman | |
| 2008/0003124 | A1 * | 1/2008 | Eisenmann | 418/61.3 |
| 2008/0031760 | A1 * | 2/2008 | Phillips et al. | 418/61.3 |

* cited by examiner

INTEGRATED HYDRAULIC MOTOR AND WINCH

CROSS REFERENCE TO RELATED APPLICATIONS

The present application claims the benefit of the filing date of U.S. Provisional Application Ser. No. 61/144,855, filed Jan. 15, 2009, the disclosure of which is incorporated herein by reference in its entirety.

TECHNICAL FIELD

This invention relates to hydraulic fluid powered driven member assemblies. More specifically, this invention relates to an integral hydraulic motor and driven member. Still more specifically, this invention relates to an integral hydraulic motor and spool, and to a winch that includes such a motor and spool.

BACKGROUND OF THE INVENTION

A hydraulic fluid powered driven member commonly includes a driven member and a hydraulic motor. The driven member may be a sprocket, a sweeper brush, a screw, a gear, a winch, a cutter, a horizontal or vertical drilling or boring assembly, or any other device. When the driven member is a winch, the winch commonly includes a spool upon which a cable is wound and a motor to provide power to the spool. The spool is connected to the motor, generally through a gear train. Operation of the motor results in rotation of the spool for, depending upon the direction of rotation, extending or retracting an amount of cable from the spool.

Hydraulic motors powered by hydraulic fluid from a fluid pressure source, and electric motors powered by electricity from an electrical power source, are both commonly used to power spools. Applications for motor driven spools include winches as mentioned above, in which the winch cable is wrapped around the spool multiple times. Other applications for motor powered spools may include conveyor belts and drive belts, in which an endless conveyor belt or drive belt wraps partially around the spool and is driven by the spool to convey goods or to drive other devices. Hydraulic motors may offer an advantage over electric motors to drive spools, and particularly spools that are used in winches, by offering a higher power density (power per unit of volume) than electric motors.

U.S. Pat. No. 6,095,500 discloses the use of low speed high torque hydraulic motors for powering a hydraulic winch spool. According to the disclosure of that patent, the motors are either gear reduction motors, which may use a complicated series of gears to lower the speed and achieve higher torque for the spool, or radial piston motors, which may require a complicated fluid system for providing fluid to the various pistons and their associated cylinders.

It is also known to directly drive the spool of a winch with a hydraulic motor. U.S. Pat. No. 7,261,277 discloses a hydraulic motor that is located adjacent an end of a winch spool and that is operable to rotate the spool when a clutch is engaged.

U.S. Pat. No. 4,457,677 discloses a low speed high torque hydraulic motor in which an outer ring of the assembly is fixed to and rotates with a drive shaft. An inner star is held against rotation by a universal shaft assembly.

Additionally, high efficiency, high flow, two speed hydraulic gerotor motors are known that use two separate power elements on a common rotating output shaft. An integral selector valve shifts between a parallel fluid connection among the power elements to provide high torque low speed operation and a series fluid connection among the power elements to provide low speed high torque operation. In the high torque low speed parallel operation mode, the motor provides twice the torque and half the speed relative to the low torque high speed series operation mode. The selector valve can be open center or closed center and may be actuated by an external pilot or optional solenoid valve. This type of hydraulic motor is available from Parker Hannifin Corporation, Hydraulic Pump and Motor Division, as a series 700 hydraulic motor and is further described at www.parker.com.

Increasing the line pull (force applied to the cable by the winch) and the length of the line while decreasing the overall dimensions and weight of the winch may be desirable for any winch. Also, decreasing the complexity and cost of the winch may be desirable. This may be particularly true with non-stationary winches, including those carried on vehicles where space may be limited and added weight may negatively affect vehicle performance.

SUMMARY OF THE INVENTION

This invention provides a hydraulic fluid powered driven member assembly that includes a support unit, a hydraulic motor, and a driven member integral with the hydraulic motor. The hydraulic motor receives fluid from a fluid pressure source and rotates the integral driven member, which may be a spool. The spool may receive a winch cable, and rotation of the spool may extend and retract the winch cable.

The integral hydraulic motor according to this invention includes at least one power group having at least one power unit. The power unit includes an inner gerotor rotor and an outer gerotor rotor and variable volume fluid power chambers that are defined by opposing surfaces of the inner and outer gerotor rotors. The support unit includes a stationary member, and the inner gerotor rotor is fixed against movement relative to the stationary member. The outer gerotor rotor moves along a rotational and orbital path. The outer gerotor rotor drives the spool along a non-orbital rotational path. The inner and outer gerotor rotors and the chambers are located inside and are integrated with the spool.

The hydraulic motor may include a plurality of such power groups, and each power group may include a plurality of such power units. The inner gerotor rotors of the power units of each of the power groups are separately fixed to one another and to the support unit. The outer gerotor rotors of the power units of each power group are also separately fixed to one another, and the outer gerotor rotors that are fixed together move together along the same hypocycloidal path. The fluid pressure communication among the power groups may be series or parallel. Valves may change the direction of flow through the power units to change the direction of rotation of the outer rotors and the integral spool, and other valves may change the fluid pressure communication among the power groups between series and parallel to change the speed and torque provided by the outer gerotor rotors to the integral spool. The power groups may be circumferentially indexed relative to one another, to smooth pressure and torque ripples and increase average torque during operation. The power groups may have different volumetric displacement power units, to provide three speed operation with two power groups.

The invention also provides various ones of the features and structures described in the claims set out below, alone and in combination, which claims are incorporated by reference in this summary of the invention.

BRIEF DESCRIPTION OF THE DRAWINGS

Embodiments of this invention will now be described in further detail with reference to the accompanying drawings, in which.

DETAILED DESCRIPTION OF THE INVENTION

The principles, embodiments and operation of the present invention are shown in the accompanying drawings and described in detail herein. These drawings and this description are not to be construed as being limited to the particular illustrative forms of the invention disclosed. It will thus become apparent to those skilled in the art that various modifications of the embodiments herein can be made without departing from the spirit or scope of the invention.

The hydraulic powered driven member assembly and spool and winch of the present invention provides increased spool or driven member torque and increased winch line pull in a smaller, lighter weight package than conventional hydraulic driven members and spools and winches. The increased torque and line pull in the smaller, lighter package results from the use of a unique, integrated hydraulic rotary motor, spool and winch, as will be described in further detail below.

Figure 1:
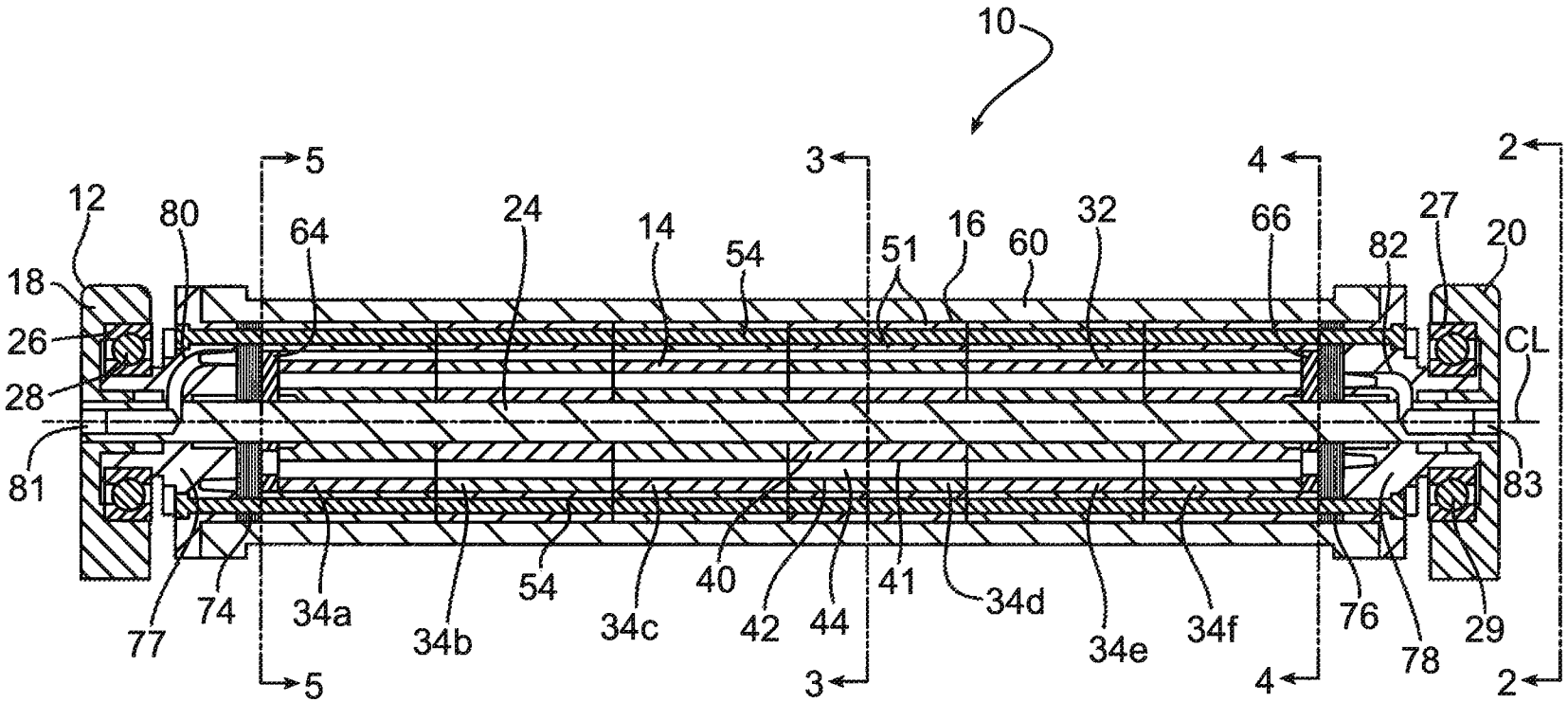
FIG. 1 is a longitudinal cross sectional view of a hydraulic fluid powered spool assembly according to a preferred embodiment incorporating certain principles of this invention.
Figure 2:
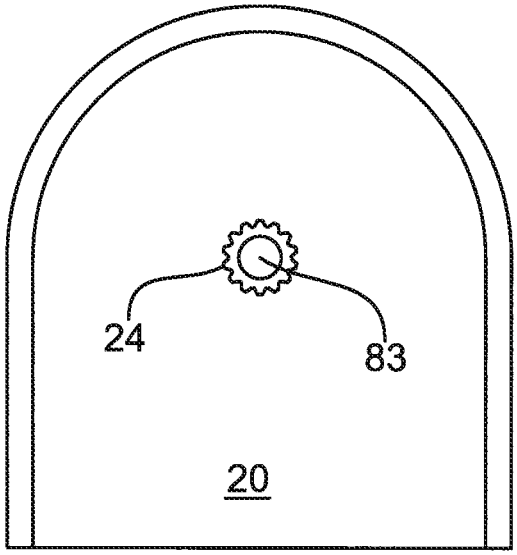
FIG. 2 is an enlarged end elevation view along reference view line 2-2 in FIG. 1.

FIG. 1 illustrates a longitudinal cross section of a hydraulic powered driven member or spool assembly 10 in accordance with a preferred embodiment of this invention. The assembly 10 includes a support unit 12, a hydraulic motor 14, and a driven member or spool 16 integral with the hydraulic motor 14. The term integral herein means formed as a unit such that each is an essential part to complete the other.

The support unit 12 includes two stationary support members 18 and 20 that are axially spaced along centerline CL. The support members 18 and 20 may each include suitable threaded bolt holes (not shown) extending into their bottom surface to attach the support members 18 and 20 to a vehicle mounting member (also not shown) or to any other desired mounting structure. The support members 18 and 20 are similar to one another and are each manufactured from a suitable high strength material. A center through-shaft 24 extends between and is affixed, such as with splines, to mating surfaces, such as splined holes, in each of the support members 18 and 20 to secure the center through-shaft 24 against movement relative to the support members 18 and 20 of the support unit 12. The through-shaft 24 forms a central axis for the hydraulic fluid powered spool assembly 10.

Bearing cavities 26 and 27 are provided in the support members 18 and 20, respectively, with the centerline of the bearing cavities 26 and 27 being the same as the centerline CL. The bearing cavities 26 and 27 receive conventional ball bearing assemblies 28 and 29, respectively. The ball bearing assemblies 28 and 29 each include an outer bearing race that is press fit into its associated bearing cavity and an inner bearing race that is mounted for rotation relative to its associated outer bearing race. The bearing cavities 26 and 27 and their associated bearing assemblies 28 and 29 provide support portions that rotatably support the driven member or spool 16 relative to the stationary support members 18 and 20.

The hydraulic motor 14 includes a power group 32. The power group 32 includes at least one gerotor power unit, and in the embodiment shown in FIG. 1 the power group 32 includes six internally generated rotor gerotor power units **34*a*-34*f*. The gerotor power units 34*a*-34*f* are each of the type generally described in U.S. Pat. No. 4,563,136, which is incorporated herein by reference in its entirety. Alternatively, the gerotor power units could be any other suitable type of gerotor unit such as an externally generated rotor gerotor power unit. The differences between internally generated and externally generated gerotor power units are well known and are generally explained in U.S. Pat. No. 6,617,367, the entirety of which is incorporated herein by reference. The number, axial length, diameter, number of gerotor teeth, and other known parameters of each gerotor power unit 34*a*-34*f* can be modified according to the requirements of particular application for the hydraulic fluid powered spool assembly 10**.

Figure 3:
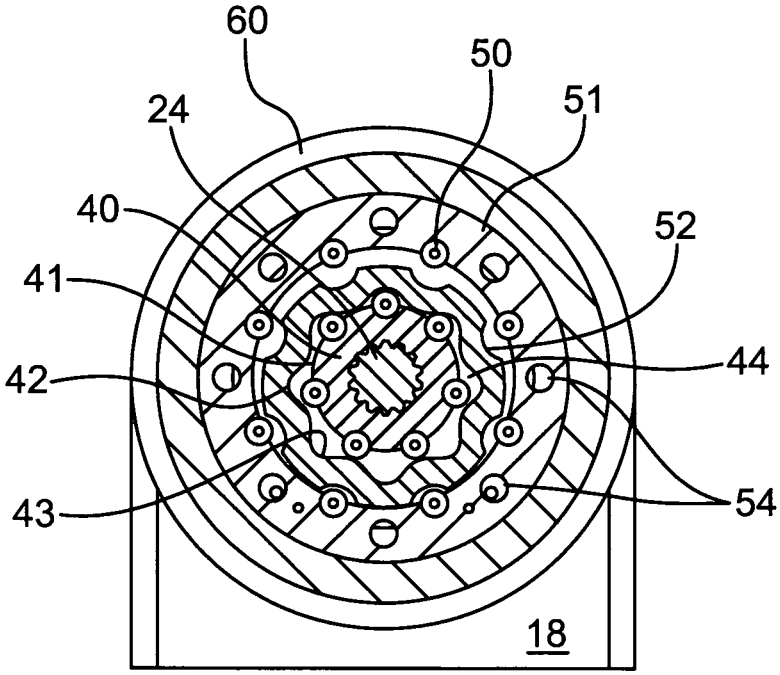
FIG. 3 is an enlarged lateral cross sectional view along reference view line 3-3 in FIG. 1.

The gerotor power units **34*a*-34*f* are substantially identical to one another, and FIG. 3 illustrates a cross-section of power unit 34*d*. As can be seen with reference to FIG. 3, each power unit 34*a*-34*f* includes an inner rotor 40 and an outer rotor 42. The inner rotor 40 of each power unit is affixed to the through-shaft 24, such as with splines as shown in FIG. 3. Thus, the through-shaft 24 extends axially completely through the inner rotors 40 of each power unit 34*a*-34*f*, and each such inner rotor 40 is secured against movement relative to one another and relative to the support unit 12. Each of the inner rotors 40 also includes a plurality of roller cavities and a roller in each such cavity, so that the inner rotors 40 each provide a radially outwardly facing surface 41** that provides a plurality of gerotor teeth.

The outer rotor 42 includes a radially inwardly facing surface 43. The inwardly facing surface 43 of the outer rotor 42 and the outwardly facing surface 41 of the inner rotor 40 of the power unit **34*f* cooperatively define a plurality of variable volume fluid chambers 44 that are separated by virtual contact lines between the surfaces 41 and 43 and that expand and contract as the outer rotor 42 moves along its hypocycloidal path. Hydraulic fluid under pressure is supplied to the expanding chambers from a source of fluid pressure (not shown) to cause this movement of the outer rotor 42**, and hydraulic fluid is returned to the source of fluid pressure from the contracting fluid chambers, all in a well known manner.

Referring to FIGS. 1 and 3 together, non-orbital rotational movement and torque from the outer rotor 42 of the power unit **34*a* are transferred to the spool 16, and the spool 16 provides an integral portion of the power unit 34*a* of the hydraulic motor 14 to support the outer rotor 42. This torque transfer and support are provided by a plurality of pins or dowels 50 located on the inner periphery surface of driven member or spool segment 51 of the spool 16 and by associated driving contours 52 on the outer surface of the outer rotor 42. The spool segment 51 supports the outer rotor 42 substantially entirely within the spool segment 51. The axial extent of the driving contours 52 and pins 50 and spool segments 51 of each power unit 34*a*-34*f* is substantially equal to the axial extent of the inner rotor 40 and outer rotor 42 of each such power unit. A plurality of bolt or locking pin holes extend axially completely through the spool segments 51 and receive a locking pin 54 that extends substantially the entire axial length of the power group 32 and secures the spool segments 51 of the power units 34***a-f* to one another to provide a continuous spool 16 that extends axially substantially coextensively with the power group 32. Alternatively, the individual spool segments 51 of the power units 34*a*-34*f* may be secured together by any other suitable mechanism or may extend axially further than one power unit or may be constructed as a unitary member that extends substantially the entire axial length of the power group 32. In this manner, the spool segments 51 support the outer rotors 42 and provide an integral part of the hydraulic motor 14. A cable receiving member 60 is provided on the exterior of the spool 16 and rotates with the spool 16 to receive a cable (not shown) that is wrapped along the outside of the member 60 in non-overlapping abutting wraps. Alternatively, the member 60 may be any other desired or suitable member, such as a sprocket, a sweeper brush, a screw, a gear, a cutter, a horizontal or vertical drilling or boring assembly, or any other device. Also, the member 60 is a separate member from the driven member segments 51 for manufacturing convenience and versatility in the preferred embodiment, but may alternatively be integral with the driven member segments 51.

Figure 4:
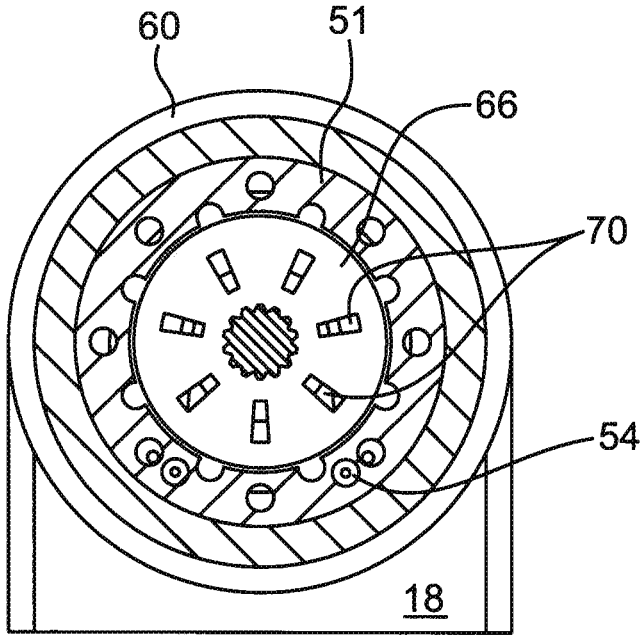
FIG. 4 is an enlarged lateral cross sectional view along reference view line 4-4 in FIG. 1.
Figure 5:
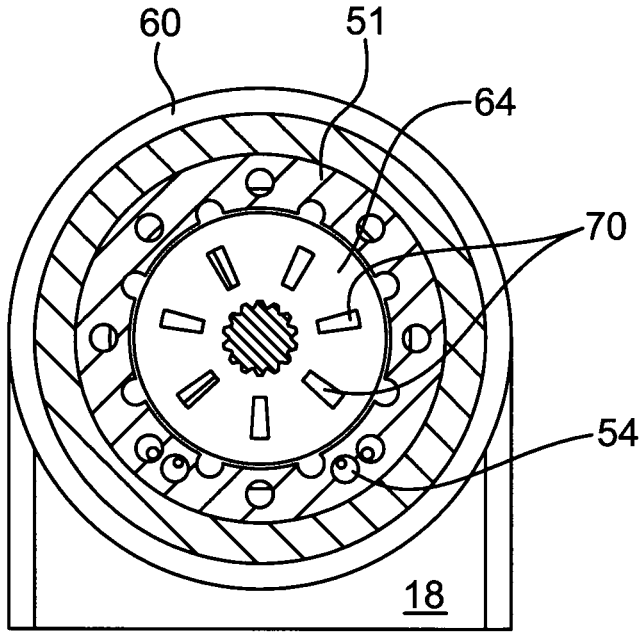
FIG. 5 is an enlarged lateral cross sectional view along reference view line 5-5 in FIG. 1.

As shown in FIG. 1, the hydraulic motor 14 also includes fluid valves 64 and 66. FIG. 4 illustrates valve 66 and FIG. 5 illustrates valve 64. The valves 64 and 66 are fixed to the through-shaft 24, such as by splines, so that the valves 64 and 66 along with the inner rotors 40 of the power units 34*a*-34*f* are all secured against movement relative to one another and relative to the support members 18 and 20. In the embodiment of FIG. 1, the valves 64 and 66 are located within the spool or driven member segments 51 of the first and last power elements 34*a* and 34*f* of the hydraulic motor 40 in a position for controlling fluid flow into and out of the fluid chambers 44 between the inner rotor 40 and the outer rotor 42 of each power element 34*a*-34*f*. As illustrated in FIGS. 4 and 5, each of the valves 64 and 66 includes a plurality of circumferentially spaced flow openings or passages 70 for controlling this fluid flow.

Still referring to FIG. 1, the hydraulic motor 30 also includes two flow manifolds 74 and 76. The flow manifolds 74 and 76 are conventional gerotor manifolds that are formed from a plurality of flat thin manifold plates that are stacked and brazed together to form each manifold. The manifolds 74 and 76 each have a plurality of fluid flow passages extending axially through the manifolds for conveying fluid to and from the valves 64 and 66 and the chambers 44. The manifolds 74 and 76 are located on axially opposite ends of the hydraulic motor 30 and are fixed by the pins 54 to the driven member or spool segments 51 of the spool 16 for rotation with the spool 16.

End carrier plates 77 and 78 are provided at the axial end regions of the hydraulic motor 30 and are secured to the inner race of the ball bearing assemblies 28 and 29, respectively, to rotatably support the spool 16 relative to the stationary support members 18 and 20. A fluid flow path or passage 80 extends through end carrier plate 77. As the spool 16 and end carrier plate 77 rotate relative to the through-shaft 24, the flow manifold 74 rotates and a fluid flow path through the rotating manifold 74 and stationary control valve 64 communicates with the fluid chambers 44 of the power units 34*a*-34*f* as the passages in the manifold 74 overlap the openings in the control valve 64. A flow passage 81 in the through-shaft 24 is hydraulically connected to the passage 80. Similarly, a fluid flow path or passage 82 extends through end carrier plate 78. As the spool 16 and end carrier plate 78 rotate relative to the through-shaft 24, the flow manifold 76 rotates and a fluid flow path through the rotating manifold 76 and stationary control valve 66 communicates with the fluid chambers 44 of the power units 34*a*-34*f* as the passages in the manifold 76 overlap the openings in the control valve 66. A flow passage 83 in the through-shaft 24 is hydraulically connected to the passage 82. One of the passages 81 and 83 in the stationary through-shaft 24 is connected to supply fluid pressure from the fluid pressure source (not shown), and the other is connected to return drain pressure to the fluid pressure source. The fluid pressure source may be any conventional source of fluid pressure such as a fixed or variable displacement pump or a control valve or other hydraulic device in a fluid pressure circuit.

When the hydraulic powered driven member assembly 10 is used as a winch, the spool 16 is rotatable to both extend and retract a cable that is wound on the outer cylindrical surface of the member 60. The direction of rotation of the spool 16 is dependent upon the direction of flow through the hydraulic motor 30. Flow from passage 81 and valve 64 toward valve 66 and passage 83 causes rotation of the spool 16 in a first direction, while flow from passage 83 and valve 66 toward valve 64 and passage 81 causes rotation in a second direction.

During operation of the hydraulic motor 30, fluid flowing into the hydraulic motor through valve 64, for example, enters the expanding ones of the pockets or chambers 44 of the power unit 34*a* and, then subsequently, the expanding ones of the chambers 44 of the power units 34*b*-34*f*. As additional fluid flows into a chamber 44, the chamber 44 expands causing the outer rotor 42 to move about the inner rotor 40. The rotary component of the hypocycloidal movement and torque of the outer rotor 42 are transferred to the spool 16 through the pins 50 and contours 52 to cause rotation of the spool 16.

The power units 34*a*-34*f* are pressure loaded against internal leakage for high volumetric efficiency. Therefore, the hydraulic motor 30 is wear compensated so that its volumetric efficiency does not degrade with use. The straight through-shaft 24 allows for full stationary contact between the shaft and inner rotor 40 along the entire axial extent of each inner rotor 40 so as to minimize contact stresses. The hydraulic motor 30 also provides the gear reduction required to produce high amounts of torque.

Figure 6:
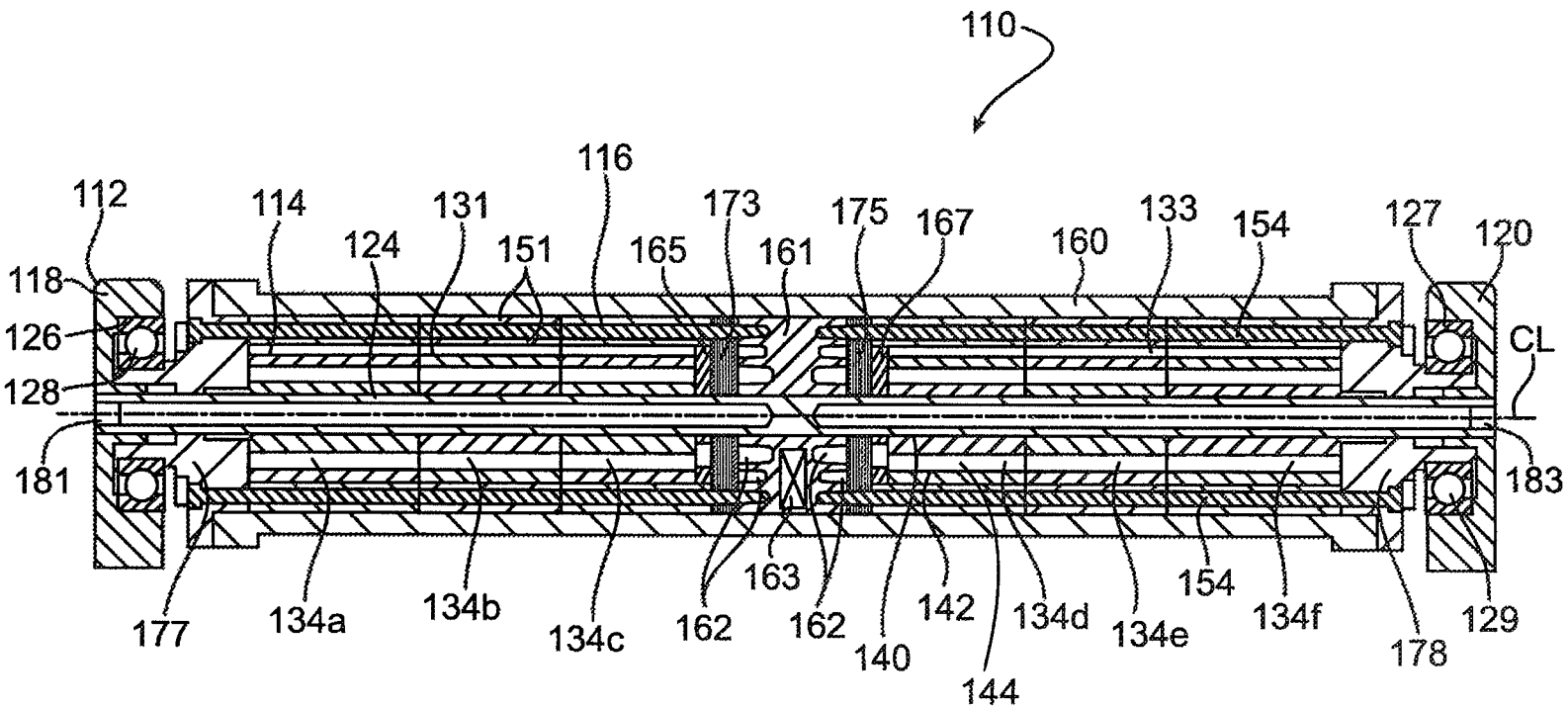
FIG. 6 is a longitudinal cross sectional view of a hydraulic fluid powered spool assembly according to an alternative embodiment incorporating certain principles of this invention.

FIG. 6 illustrates alternative embodiments of a hydraulic powered driven member or spool assembly 110 that provide multiple speeds and torque outputs for the driven member or spool 116. Components shown in FIG. 6 that are similar to those shown in FIGS. 1-5 are provided with the same reference numbers but with a "1" prefix. Thus, reference numerals 112, 118, 126, 128, 177, 178, 129, 120 and 127 denote in FIG. 6 components similar to components 12, 18, 26, 28, 77, 78, 29, 20 and 27, respectively, of the above-described embodiment(s). The structure and operation of such components in FIG. 6 are according to the above description relating to FIGS. 1-5, except to the extent otherwise shown in FIG. 6 or otherwise described below.

The hydraulic porting for the spool assembly 110 can be in series or parallel across the multiple power units 134*a*-134*f* to achieve multiple output torques and speeds. Series fluid pressure communication among fluid devices means sequential fluid pressure communication in which the same fluid flows through the fluid devices one after the other. Parallel fluid pressure communication among fluid devices means simultaneous fluid pressure communication in which the fluid flow is separated with a portion of such fluid flowing separately to each of the fluid devices.

In the embodiment shown in FIG. 6, the hydraulic motor 114 is divided into a first power group 131 and a second power group 133. The first and second power groups 131 and 133 each include one or more power units. The first power group 131 includes power units 134*a*-134*c*, and the second power group 133 includes power units 134*d*-134*f*.

A central fluid distribution block 161 is provided between the power groups 131 and 133. The distribution block 161 includes four concentric annular ports 162. A valve member 163 is connected by passages not shown in FIG. 6 to passages 181 and 183 that extend from opposite ends of the through-shaft 124. The valve member 163 is operated by fluid pilot pressure signals or by electrical signals to connect the passages 181 and 183 to the concentric annular ports 162 to establish series or parallel flow from the passages 181 and 183 through the first and second power groups 131 and 133.

Fluid from the annular ports 162 is provided to gerotor manifolds 173 and 175. The manifolds 173 and 175 are somewhat similar in construction to the manifolds 74 and 76 shown in FIG. 1, but the passages (not shown) through the manifolds 173 and 175 are different. The passages through the manifolds 173 and 175 are aligned with passages in the valves 165 and 167, respectively. The control valve 165 and its respective manifold 173 supplies fluid pressure to and receives return flow from the power units 134*a*-134*c* of power group 131. Similarly, the control valve 167 and its respective manifold 175 supplies fluid pressure to and receives return flow from the power units 134*d*-134*f* of power group 132.

When the distribution valve 163 connects the passages 181 and 183 for series flow through the power groups 131 and 133, the spool 116 is rotated at a relatively higher speed and lower torque than that achieved with parallel flow operation described below. When the distribution valve 163 connects the passages 181 and 183 for parallel flow through the power groups 131 and 133, each receive only one half the amount of fluid received in series flow but such fluid is at a higher pressure level as it flows through the power groups 131 and 133. The spool 116 in this parallel condition is rotated at a relatively lower speed and higher torque than that achieved with series flow operation described above. Also, the direction of fluid flow through the power groups 131 and 133 can be reversed by reversing the fluid flow through the passages 181 and 183 or by operation of the distribution valve 163, to change the direction of rotation of the spool 116 with either higher speed or lower speed rotation of the spool 116. Furthermore, the valves may be used to run either power group 131, 133 independently allowing for asymmetrical power groups described below. When the hydraulic powered driven member assembly 110 is used as a winch, the multiple speeds may be desirable to assist paying out or extending a cable at a faster rate than the cable is retracted.

In the embodiment of the hydraulic powered driven member assembly 110 described above, the power units 134*a*-134*f* of the power groups 131 and 133 are in circumferential alignment, so that each inner rotor 140, outer rotor 142, fluid chamber 144 and driven member segment 151 are circumferentially aligned with one another. Also, the volumetric displacement of each fluid chamber 144 of each power unit of each of the power groups 131 and 133 is substantially equal to one another. This arrangement may be called symmetrical power groups, because the torque and displacement of the power units 131 and 133 is substantially equal to one another and in phase with one another during parallel operation In an alternative embodiment of the hydraulic powered driven member assembly 110 illustrated in FIG. 6, the power groups 131 and 133 are asymmetrical, because the torque and/or displacement of the power groups 131 and 133 is substantially asymmetrical. In one such alternative embodiment, the power units 134*a*-134*c* of the first power croup 131 are circumferentially indexed relative to the power units 134*d*-134*f* of the second power group 133. This alternative embodiment may be achieved by circumferentially indexing the driven members 151 of the first power group 131 relative to the driven members 151 of the second power group 133. This circumferential indexing may be accomplished by circumferentially indexing the locking pin holes 154 of the driven member segments 151 of the first power group relative to the locking pin holes 154 of the driven member segments 151 of the second power group 133. This asymmetrical embodiment may alternatively be achieved by indexing the splines and valves of each of the power groups 131 and 133 relative to one another. This asymmetrical embodiment causes the pressure and torque peaks and troughs of the first power group 131 to be out of phase with the pressure and torque peaks and troughs of the second power group 133. By adjusting the amount of the circumferential indexing of the power groups 131 and 133 relative to one another, the maximum torque and pressure peaks and the minimum torque and pressure troughs for the combined power groups 131 and 133 during parallel operation can be reduced to decease pressure and torque ripples. Also, the average torque value for the combined power groups 131 and 133 may be increased.

In another such alternative asymmetrical embodiment, the power groups 131 and 133 are of substantially different volumetric displacement. The volumetric displacement of a power unit is the total volume of all of the fluid chambers of the power unit, and the volumetric displacement of a power group is the total volumetric displacement of all of the power units of that power group. In this embodiment, the volume of each fluid chamber 144 of each power unit 134*a*-134*c* of the first power group 131 is larger than the volume of each of the fluid chambers 144 of the second power group 133. In this asymmetrical embodiment, one rotational speed and torque of the hydraulic powered driven member assembly 110 will be achieved when hydraulic fluid under pressure is provided to the first power group 131 and only make up flow is provided to the second power group 133. A second higher speed and lower torque of the hydraulic powered driven member assembly 110 will be achieved when hydraulic fluid under pressure is provided to the second power group 133 and only make up flow is provided to the first power group 131. A third lowest rotational speed and highest torque output of the hydraulic powered driven member assembly 110 will be achieved when hydraulic fluid under pressure is provided in parallel to both the first power group 131 and the second power group 133. In those instances in which make up flow may be utilized, such flow may be either drain or return or inlet pressure flow. The differences between and among the various arrangements of these asymmetrical embodiments is described above but not further illustrated in additional drawings similar to FIG. 6, because such additional drawings would be repetitive and therefore unnecessary.

When the hydraulic powered driven member assembly 10 or 110 of the present invention is used as a winch, the present invention eliminates a separate gearbox and combines the hydraulic motor and the spool into an integral unit. The spool segments 51 and 151 provide a part of the hydraulic motors 14 and 114 by supporting the outer rotors 42 and 142, respectively, and also provide a part of the spools 16 and 116, respectively. The end result is a design that is light weight and more compact in size. Thus, power density is further increased relative to known hydraulic winches. Additionally, the spool runs the full length of the winch allowing a cable to be wrapped over a much longer axial distance to optimize mechanical advantage and create more usable line pull forces. Winches with shorter spools lose mechanical advantage as the cable layers upon itself.

The present design may be integrated further with a hydraulic pump mounted to the motor. The pump may be driven by an electric motor with or without a hydraulic power limiting device. The package then requires only electrical input to create rotary motion. The pump itself could be a variable displacement over-center pump eliminating the need for a control valve to change the direction of flow. If the pump is not mounted directly on the hydraulic motor, it may be mounted on a vehicle engine either directly or through a clutch.

The winch may include a brake, such as an external brake, either hydraulic or mechanical. One brake concept involves using a mechanical device on the largest diameter of the spool to gain a mechanical advantage. The hydraulic motor may include a hose or flow path so that fluid ported to the hydraulic motor may be from only one end of the spool assembly. This allows for a single control valve that will control speed and the direction of rotation of the motor.

Presently preferred embodiments of the invention are shown in the drawings and described in detail above. The invention is not, however, limited to these specific embodiments. Various changes and modifications can be made to this invention without departing from its teachings, and the scope of this invention is defined by the claims set out below.

What is claimed is:

1. A hydraulic powered spool assembly comprising:

a support unit;

a spool rotatable about an axis relative to the support unit;

a hydraulic motor responsive to receiving hydraulic fluid for rotating the spool relative to the support unit; and the hydraulic motor being integral with the spool;

wherein said hydraulic motor is an internally generated rotor type gerotor motor having at least one power unit, said at least one power unit includes an inner rotor that is fixed against rotational movement relative to the support unit, an outer rotor that is rotatably disposed relative to said support unit to move about said inner rotor in response to fluid being received in variable displacement chambers located between said inner and outer rotors, said inner rotor and said outer rotor and said chambers being disposed substantially entirely within said spool, and said spool being rotatably disposed relative to said support unit for non-orbital rotation as a result of rotation of said outer rotor.

2. The hydraulic powered spool assembly of claim 1 wherein said spool includes links that support said outer rotor of said power unit.

3. A hydraulic powered driven member assembly comprising:

a support unit;

a driven member rotatable about an axis relative to the support unit;

a hydraulic motor responsive to receiving hydraulic fluid for rotating the driven member relative to the support unit;

said hydraulic motor includes an inner gerotor rotor, an outer gerotor rotor, said inner gerotor rotor having a radially outwardly facing gerotor surface, said outer gerotor rotor having a radially inwardly facing gerotor surface radially opposed to said outwardly facing gerotor surface, said gerotor surfaces cooperatively defining variable volume gerotor fluid power chambers;

said support including one support portion fixedly supporting said inner gerotor against rotational movement relative to said support unit, another support portion rotatably supporting said driven member for non-orbital rotational movement relative to said support unit;

and said driven member supporting said gerotor outer rotor.

4. The hydraulic powered driven member assembly as set forth in claim 3 wherein said driven member includes a first drive link, said gerotor outer rotor includes a second drive link, said drive links engaging one another to transfer non-orbital rotational torque from said gerotor outer rotor to said driven member for causing rotation of said driven member relative to said support unit and relative to gerotor inner rotor, and fluid pressure passages and fluid return passages alternately connected to each of said chambers to supply fluid pressure to and return fluid pressure from said chambers.

5. The hydraulic powered driven member assembly as set forth in claim 3 wherein said one support portion includes a stationary member that extends axially at least partially through said inner rotor and that is secured against movement relative to said support unit.

6. The hydraulic powered driven member assembly as set forth in claim 5, wherein said hydraulic motor includes a plurality of power groups, each of said power groups includes at least one gerotor power unit, each of said power units includes a gerotor inner rotor, and said stationary member extends axially completely through each of said gerotor inner rotors.

7. The hydraulic powered driven member assembly as set forth in claim 6, including one fluid passage supplying fluid pressure to said chambers and another fluid passage carrying fluid from said chambers, at least one of said passages being disposed within said stationary member.

8. The hydraulic powered driven member assembly as set forth in claim 3, wherein said hydraulic motor includes a plurality of power groups, each of said power groups includes at least one gerotor power unit, each of said gerotor power units includes a stationary inner rotor and an outer rotor disposed for hypocycloidal movement and variable volume chambers between said inner and outer rotors, a fluid flow path through said chambers of each of said power groups, and said fluid flow path through said chambers of one of said power groups is in parallel with the fluid flow path through said chambers of another of said power groups.

9. The hydraulic powered driven member assembly as set forth in claim 3, wherein said hydraulic motor includes a plurality of power groups, each of said power groups includes at least one gerotor power unit, each of said gerotor power units includes a stationary inner rotor and an outer rotor disposed for hypocycloidal movement and variable volume chambers between said inner and outer rotors, a fluid flow path through said chambers of each of said power groups, and said fluid flow path through said chambers of one of said gerotor power groups is in series with said fluid flow path through said chambers of another of said power groups.

10. The hydraulic powered driven member assembly as set forth in claim 3 wherein the driven member is a spool, said hydraulic motor includes a plurality of power groups, each of said power groups includes at least one gerotor power unit, each of said gerotor power units includes a stationary inner rotor and an outer rotor disposed for hypocycloidal movement and variable volume chambers between said inner and outer rotors, a fluid flow path through said chambers of each of said power groups, a fluid flow control valve disposed within said spool between one of said power groups and another of said power groups, said fluid flow control valve having a first position and a second position, said fluid flow control valve including passages connecting said fluid flow path through said chambers of one of said power groups in parallel with said fluid flow path through said chambers of another of said power groups when said fluid flow control valve is in said first position, and said fluid flow control valve including other passages connecting said fluid flow path through said chambers of said one of said power groups in series with said fluid flow path through said chambers of said other of said groups when said fluid flow control valve is in said second position.

11. The hydraulic powered driven member assembly as set forth in claim 3, wherein said hydraulic motor includes a plurality of power groups, each of said power groups includes at least one gerotor power unit, and each of said gerotor power units includes a stationary inner rotor and an outer rotor disposed for hypocycloidal movement and variable volume chambers between said inner and outer rotors.

12. A hydraulic powered driven member assembly comprising:

a fluid powered gerotor drive unit, a driven member, and a support assembly;

said gerotor drive unit including an inner gerotor rotor fixed against rotational movement relative to the support assembly, an outer gerotor rotor, said inner and outer gerotor rotors including respectively outer and inner gerotor gear surfaces that cooperatively define variable volume gerotor fluid chambers, valve surfaces hydraulically connected to said fluid chambers supply fluid to and receive fluid from said fluid chambers;

said outer gerotor rotor having a first drive link and said driven member having a second drive link, said first and second drive links engaging to transfer rotational torque and rotational movement from said outer rotor to said driven member;

and said inner gerotor rotor and said outer gerotor rotor and said chambers all being disposed substantially entirely within said driven member.

13. A hydraulic powered driven member assembly as set forth in claim 12 wherein:

said support assembly includes a stationary mounting member and at least one support member that engages and supports said inner gerotor rotor fixed against movement relative to said mounting member; and said support assembly includes at least one other support member that engages and supports said driven member for non-orbital rotary movement relative to said mounting member and relative to said inner gerotor rotor.

14. A hydraulic powered driven member assembly as set forth in claim 12 wherein said driven member supports said outer gerotor rotor within said driven member.

15. A hydraulic powered driven member assembly as set forth in claim 13, wherein said gerotor drive unit includes a manifold, said manifold has a plurality of passages for conveying fluid flow to and from said chambers, and said manifold is fixed to said driven member for rotation with said driven member.

16. A hydraulic powered driven member assembly comprising:

an inner gerotor rotor, an outer gerotor rotor, a driven member, and a support assembly;

said inner and outer gerotor rotors including respectively outer and inner gerotor gear surfaces that cooperatively define therebetween variable volume gerotor fluid power chambers;

said inner gerotor rotor being fixed against movement relative to said support assembly;

said outer gerotor rotor being mounted for rotational and orbital movement relative to said support assembly and relative to said inner gerotor rotor, said outer gerotor rotor having an exterior;

said driven member being mounted externally of said outer gerotor rotor for non-orbital rotary movement relative to said support assembly and relative to said inner gerotor rotor, said driven member having an interior and an exterior surface;

cooperating drive surfaces on said exterior of said outer gerotor rotor and on said interior of said driven member to transfer non-orbital rotational torque and rotational motion between said outer gerotor rotor and said driven member and to support said outer gerotor rotor within said driven member; and said external surface of said driven member moves in a non-orbital rotational path.

17. A hydraulic powered driven member assembly as set forth in claim 16 wherein:

said support assembly includes a support, one support portion fixedly supporting said inner gerotor rotor against movement relative to said support, another support portion rotatably supporting said driven member for non-orbital rotational movement relative to said support;

fluid pressure passages and fluid return passages alternately connect to each of said chambers to supply fluid pressure to and return fluid pressure from said chambers; and said one support portion includes an axially extending member that extends axially completely through said inner gerotor rotor and is secured against movement relative to said support.

18. A hydraulic powered driven member assembly as set forth in claim 17, including a plurality of power groups, and each of said power groups includes at least one gerotor power unit, each of said power units includes a gerotor inner rotor, and said axially extending member extends axially completely through each of said gerotor inner rotors.

19. A hydraulic powered driven member assembly as set forth in claim 18, wherein;

at least one of said passages is disposed within said member;

said gerotor power units of each of said power groups is disposed substantially entirely within said driven member; and said driven member exterior surface includes a generally cylindrical winch cable receiving surface.

20. A hydraulic powered driven member assembly as set forth in claim 17, including a gerotor manifold, said manifold has a plurality of passages for conveying fluid flow to and from said inner and outer rotors, and said manifold is fixed to said driven member for rotation with said driven member.

21. A hydraulic powered driven member assembly as set forth in claim 17, including a plurality of power groups, and each of said power groups includes at least one gerotor power unit, and each or said power units includes a gerotor inner rotor and a gerotor outer rotor and a fluid chamber.

22. A hydraulic powered driven member assembly as set forth in claim 21, wherein the volumetric displacement of at least one said power unit of one of said power groups is substantially larger than that of at least one said power unit of the other said power group.

23. A hydraulic powered driven member assembly as set forth in claim 21, wherein the total volumetric displacement of one of said power groups is substantially larger than that of the other said power group.

* * * * *